US008484858B2

(12) United States Patent
Brannigan et al.

(10) Patent No.: US 8,484,858 B2
(45) Date of Patent: Jul. 16, 2013

(54) WALL CONTACT CALIPER INSTRUMENTS FOR USE IN A DRILL STRING

(75) Inventors: James C. Brannigan, Cypress, TX (US); Raymond V. Nold, III, Beasley, TX (US); John C. Rasmus, Richmond, TX (US); Fernando Garcia-Osuna, Sugar Land, TX (US); Alexander Zazovsky, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 226 days.

(21) Appl. No.: 13/041,912

(22) Filed: Mar. 7, 2011

(65) Prior Publication Data

US 2012/0055711 A1 Mar. 8, 2012

Related U.S. Application Data

(63) Continuation-in-part of application No. 12/486,187, filed on Jun. 17, 2009, now Pat. No. 8,024,868.

(60) Provisional application No. 61/311,022, filed on Mar. 5, 2010.

(51) Int. Cl.
*E21B 47/08* (2012.01)
*G01B 5/12* (2006.01)

(52) U.S. Cl.
USPC ..... 33/544.3

(58) Field of Classification Search
USPC ..... 33/544.3, 544, 544.2
See application file for complete search history.

(56) References Cited

U.S. PATENT DOCUMENTS

| | | | | |
|---|---|---|---|---|
| 2,719,361 | A | 10/1955 | Richard et al. | |
| 2,719,362 | A | 10/1955 | Richard et al. | |
| 2,719,363 | A | 10/1955 | Richard et al. | |
| 3,092,182 | A | 6/1963 | Blagg | |
| 3,474,541 | A | 10/1969 | Cubberly, Jr. | |
| 3,915,229 | A | 10/1975 | Nicolas | |
| 3,977,468 | A | 8/1976 | Brewer et al. | |
| 4,006,530 | A * | 2/1977 | Nicolas | 33/544.3 |
| 4,443,948 | A * | 4/1984 | Reeves | 33/544.3 |
| 4,588,951 | A | 5/1986 | Ohmer | |
| 4,642,800 | A | 2/1987 | Umeda et al. | |
| 4,673,890 | A | 6/1987 | Copland et al. | |
| 5,092,056 | A * | 3/1992 | Deaton | 33/544 |
| 5,168,942 | A | 12/1992 | Wydrinski | |
| 5,242,020 | A | 9/1993 | Cobern | |
| 5,396,232 | A | 3/1995 | Decorps et al. | |
| 5,642,051 | A | 6/1997 | Babour et al. | |
| 5,917,774 | A | 6/1999 | Walkow et al. | |
| 6,641,434 | B2 | 11/2003 | Boyle et al. | |
| 6,647,637 | B2 | 11/2003 | Lechen | |
| 6,741,185 | B2 | 5/2004 | Shi et al. | |
| 6,848,189 | B2 * | 2/2005 | Moake et al. | 33/544 |
| 7,139,218 | B2 | 11/2006 | Hall et al. | |
| 7,421,914 | B2 * | 9/2008 | Stanley et al. | 73/865.8 |
| 8,024,868 | B2 * | 9/2011 | Brannigan et al. | 33/544.3 |
| 2006/0064889 | A1 * | 3/2006 | Fredette et al. | 33/544 |

(Continued)

*Primary Examiner* — Christopher Fulton
(74) *Attorney, Agent, or Firm* — Chadwick A. Sullivan

(57) ABSTRACT

A drill string caliper includes a mandrel configured to be coupled within a drill string. At least one laterally extensible arm is coupled to an exterior of the mandrel. A biasing device is configured to urge the at least one arm into contact with a wall of a wellbore. A sensor is configured to generate an output signal corresponding to a lateral extent of the at least one arm.

18 Claims, 5 Drawing Sheets

U.S. PATENT DOCUMENTS

2006/0214814 A1 9/2006 Pringnitz et al.
2006/0249307 A1 11/2006 Ritter et al.
2007/0192031 A1 8/2007 Li et al.
2008/0068211 A1 3/2008 Aiello et al.

* cited by examiner

WALL CONTACT CALIPER INSTRUMENTS FOR USE IN A DRILL STRING

RELATED APPLICATIONS

The present application is a continuation-in-part application and claims priority from U.S. Pat. No. 8,024,868, entitled "Wall Contact Caliper Instruments for Use In a Drill String," issued on Sep. 27, 2011, and claims priority from U.S. Patent Application Ser. No. 61/311,022 entitled "Wall Contact Caliper Instruments For Use in a Drill String," which are both hereby incorporated by reference in their entireties.

BACKGROUND OF THE DISCLOSURE

Measurement while drilling ("MWD") systems and methods generally include sensors disposed in or on components that are configured to be coupled into a "drill string." A drill string is a pipe or conduit that is used to rotate a drill bit for drilling through subsurface rock formations to create a wellbore therethrough. A typical drill string is assembled by threadedly coupling end to end a plurality of individual segments ("joints") of drill pipe. The drill string is suspended at the Earth's surface by a hoisting unit known as a "drilling rig." The rig typically includes equipment that can rotate the drill string, or the drill string may include therein a motor that is operated by the flow of drilling fluid ("drilling mud") through an interior passage in the drill string. During drilling a wellbore, some of the axial load of the drill string to the drill bit located at the bottom of the drill string. The equipment to rotate the drill string is operated and the combined action of axial force and rotation causes the drill bit to drill through the subsurface rock formations.

The drilling mud is pumped through the interior of the drill string by various types of pumps disposed on or proximate the drilling rig. The mud exits the drill string through nozzles or courses on the bit, and performs several functions in the process. One is to cool and lubricate the drill bit. Another is to provide hydrostatic pressure to prevent fluid disposed in the pore spaces of porous rock formations from entering the wellbore, and to maintain the mechanical integrity of the wellbore. The mud also lifts the drill cuttings created by the bit to the surface for treatment and disposal.

In addition to the above mentioned sensors, the typical MWD system includes a data processor for converting signals from the sensors into a telemetry format for transmission of selected ones of the signals to the surface. In the present context, it is known in the art to distinguish the types of sensors used in a drill string between those used to make measurements related to the geodetic trajectory of the wellbore and certain drilling mechanical parameters as "measurement while drilling" sensors, while other sensors, used to make measurements of one or more petrophysical parameters of the rock formations surrounding the wellbore are frequently referred to as "logging while drilling" ("LWD") sensors. For purposes of the description of the present invention, the term MWD or "measurement while drilling" is intended to include both of the foregoing general classifications of sensors and systems including the foregoing, and it is expressly within the scope of the present invention to communicate any measurement whatsoever from a component in drill string to the surface using the method to be described and claimed herein below.

Communicating measurements made by one or more sensors in the MWD system is typically performed by the above mentioned data processor converting selected signals into a telemetry format that is applied to a valve or valve assembly disposed within a drill string component such that operation of the valve modulates the flow of drilling mud through the drill string. Modulation of the flow of drilling mud creates pressure variations in the drilling mud that are detectable at the Earth's surface using a pressure sensor (transducer) arranged to measure pressure of the drilling mud as it is pumped into the drill string. Forms of mud flow modulation known in the art include "negative pulse" in which operation of the valve momentarily bypasses mud flow from the interior of the drill string to the annular space between the wellbore and the drill string; "positive pulse" in which operation of the valve momentarily reduces the cross-sectional area of the valve so as to increase the mud pressure, and "mud siren", in which a rotary valve creates standing pressure waves in the drilling mud that may be converted to digital bits by appropriate phasing of the standing waves. It is also known in the art to communicate signals between the surface and instrumentation in a wellbore using "wired" drill pipe,", that is, segmented pipe having an electromagnetic communication channel associated therewith. See, e.g., U.S. Pat. No. 6,641,434 issued to Boyle et al. and assigned to the assignee of the present invention. It is also known in the art to use extremely low frequency (ELF) electromagnetic signal telemetry for such wellbore to surface signal communication.

It is frequently desirable to have information concerning the shape of the wellbore wall, for example, for calculating cement volume necessary to cement a pipe of casing in the wellbore. It is also desirable to know the distance between certain types of sensors and the wall of the wellbore, for example, acoustic, neutron and density sensors. Caliper devices known in the art for use in drill strings include acoustic travel time based devices. An acoustic transducer emits an ultrasonic pulse into the drilling fluid in the wellbore, and a travel time to the wellbore wall back to the transducer of the acoustic pulse is used to infer the distance from the transducer to the wellbore wall. There are circumstances in which such calipers are undesirable or fail to function properly, e.g., drilling fluid having entrained gas. It is also necessary to accurately determine the acoustic velocity of the drilling fluid proximate the caliper. Therefore, there exists a need for other types of wellbore calipers that can be used with drill strings.

SUMMARY OF THE INVENTION

A drill string caliper according to one aspect of the invention includes a mandrel configured to be coupled within a drill string. At least one laterally extensible arm is coupled to an exterior of the mandrel. A biasing device is configured to urge the at least one arm into contact with a wall of a wellbore. A sensor is configured to generate an output signal corresponding to a lateral extent of the at least one arm.

A method for measuring an internal size of a wellbore according to another aspect of the invention includes moving a drill string through a wellbore drilled through subsurface formations. At least one contact arm extending laterally from the drill string is urged into contact with a wall of the wellbore. An amount of lateral extension of the arm is translated into corresponding movement of a sensor to generate a signal corresponding to the amount of lateral extension. The method includes at least one of communicating the signal to the Earth's surface and recording the signal in a storage device associated with the drill string.

A method of instrumenting one or more of the arms with a sensor to measure a property of the formation in contact with the arm.

A method of using the sensor to measure a property of the fluid in the annulus (drilling mud) while the arm is retracted or extended.

Other aspects and advantages of the invention will be apparent from the following description and the appended claims.

DETAILED DESCRIPTION

Figure 1:
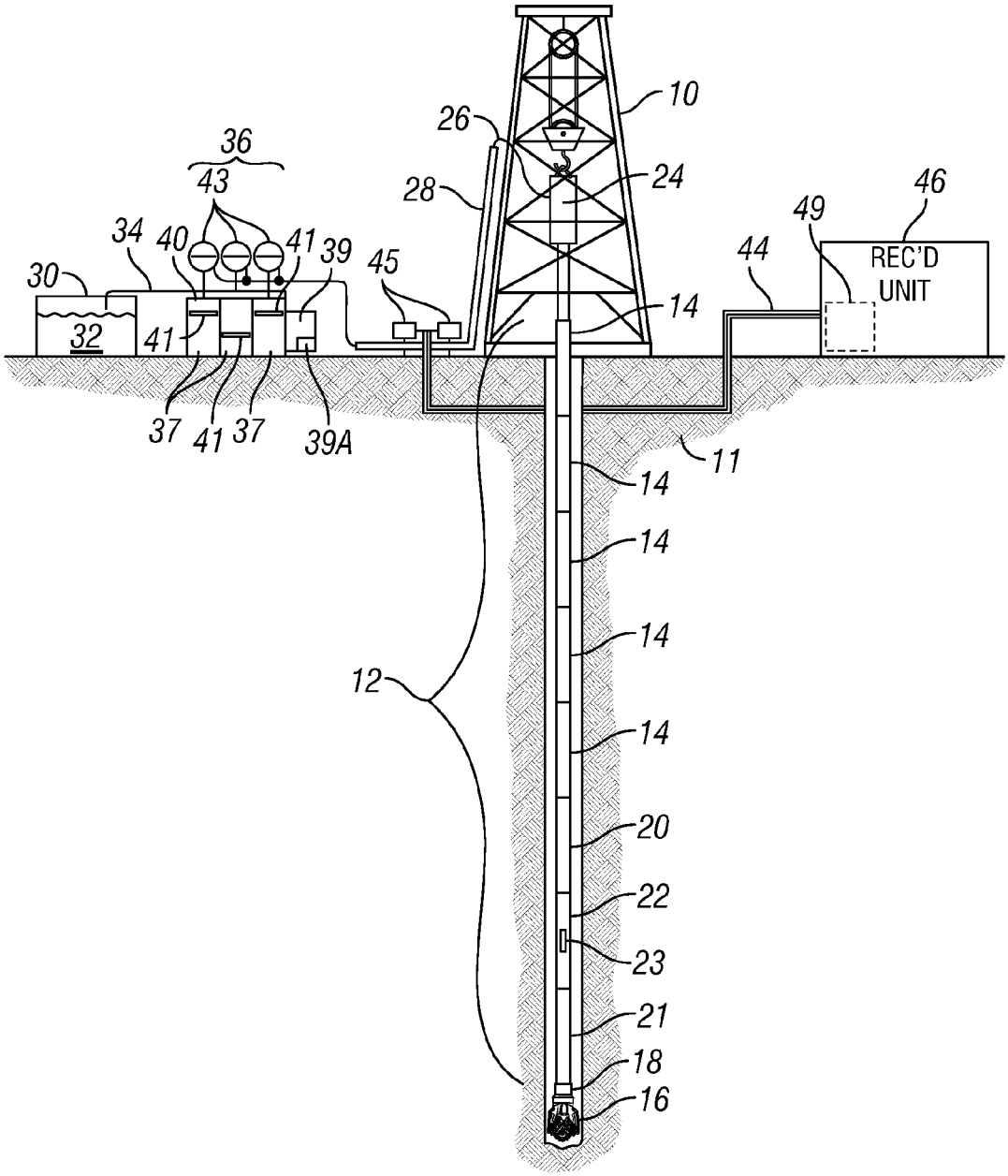
FIG. 1 shows an example drilling system.

A typical wellbore drilling system, including a measurement while drilling ("MWD") caliper device that can be used in according with various examples of the invention is shown schematically in FIG. 1. A hoisting unit called a "drilling rig" suspends a conduit of pipe called a drill string 12 in a wellbore 18 being drilled through subsurface rock formations, shown generally at 11. The drill string 12 is shown as being assembled by threaded coupling end to end of segments or "joints" 14 of drill pipe, but it is within the scope of the present invention to use continuous pipe such as "coiled tubing" to operate a drilling system in accordance with the present invention. The rig 10 may include a device called a "top drive" 24 that can rotate the drill string 12, while the elevation of the top drive 24 may be controlled by various winches, lines and sheaves (not identified separately) on the rig 10. A drill bit 16 is typically disposed at the bottom end of the drill string 12 to drill through the formations 11, thus extending the wellbore 18.

As explained in the Background section herein, drilling fluid ("drilling mud") is pumped through the drill string 12 to perform various functions as explained above. In the present example, a tank or pit 30 may store a volume of drilling mud 32. The intake 34 of a mud pump system 36 is disposed in the tank 30 so as to withdraw mud 32 therefrom for discharge by the pump system 36 into a standpipe, coupled to a hose 26, and to certain internal components in the top drive 26 for eventual movement through the interior of the drill string 12.

The example pump system 36 shown in FIG. 1 is typical and is referred to as a "triplex" pump. The system 36 includes three cylinders 37 each of which includes therein a piston 41. Movement of the pistons 41 within the respective cylinders 37 may be effected by a motor 39 such as an electric motor. A cylinder head 40 may be coupled to the top of the cylinders 37 and may include reed valves (not shown separately) or the like to permit entry of mud into each cylinder from the intake 34 as the piston 37 moves downward, and discharge of the mud toward the standpipe as the piston 37 moves upward. Typical triple pumps such as the one shown in FIG. 1 may include one or more pressure dampeners 43 coupled to the output of the pump system 36 or to the output of each cylinder to reduce the variation in pressure resulting from piston motion as explained above. In some examples, a device to count the number of movements of each piston through the respective cylinder may be coupled in some fashion to the motor or its drive output in order that the system operator can estimate the volume displaced by the pump system 36. One example is shown at 39A and is called a "stroke counter." Such devices called stroke counters are well known in the art. It should also be noted that the invention is not limited to use with "triplex" pumps. Any number of pump elements may be used in a pump system consistently with the scope of the present invention.

As the drilling mud reaches the bottom of the drill string, it passes through various MWD instruments shown therein such as at 20, 22 and 21. One of the MWD instruments, e.g., the one at 22, may include a caliper 23 which will be further explained below in more detail with reference to FIGS. 2 through 7. It should be emphasized that "MWD" as used in the present context is intended to include logging while drilling ("LWD") instrumentation as explained in the Background section herein. Pressure variations representative of the signals to be transmitted to the surface may be detected by one or more pressure transducers 45 coupled into the standpipe side of the drilling mud circulation system. Signals generated by the transducer(s) are communicated, such as over a signal line 44 to a recording unit 46 having therein a processor 49 or general purpose programmable computer 49 (or an application specific computer) to decode and interpret the pressure signals from the transducer(s) 45. In other examples, the drill string 12 may be a so called "wired" drill string and may include a signal communication channel such as an electrical and/or optical signal channel. See, for example, U.S. Pat. No. 6,641,434 issued to Boyle et al. and assigned to the assignee of the present invention for a description of a type of wired drill pipe that can be used with the present invention. It should be understood that the present invention may also be with ordinary drill pipe that does not include such signal communication channel or with "wired" drill pipe. A caliper according to the present invention may also be used with acoustic drill pipe telemetry and electromagnetic telemetry.

In particular examples wherein a wired pipe string is used for signal telemetry, it is possible to use a plurality of such caliper devices as shown at 23 at spaced apart positions along the entire drill string 12 in order to determine a longitudinal diameter profile of the wellbore. For example, the caliper devices 23 may be spaced a distance from a bottom hole assembly, tool string or drill bit of the drill string 12. In an embodiment, the caliper devices 23 may be positioned at least two pipe joints from the bottom hole assembly or tool string, or at least three pipe joints and/or other distances. Accordingly, use of only one caliper in the examples explained below is not intended to limit the scope of the present invention. In one example, a wired pipe string may include one or more signal repeaters. See, for example, U.S. Pat. No. 7,139,218 issued to Hall et al. Each signal repeater may include its own source of electric power to enable signal detection and retransmission as described in the Hall et al. '218 patent. In the present example, a caliper made according to the various aspects of the invention and described further below may be disposed proximate each of the one or more repeaters in such a wired pipe string. By locating the caliper proximate the repeater, it may be unnecessary to provide a separate source of electric power to operate the caliper as such may be provided by the power supply associated with the repeater. In an embodiment, the caliper 23 may be incorporated into a repeater or repeater sub.

Figure 2:
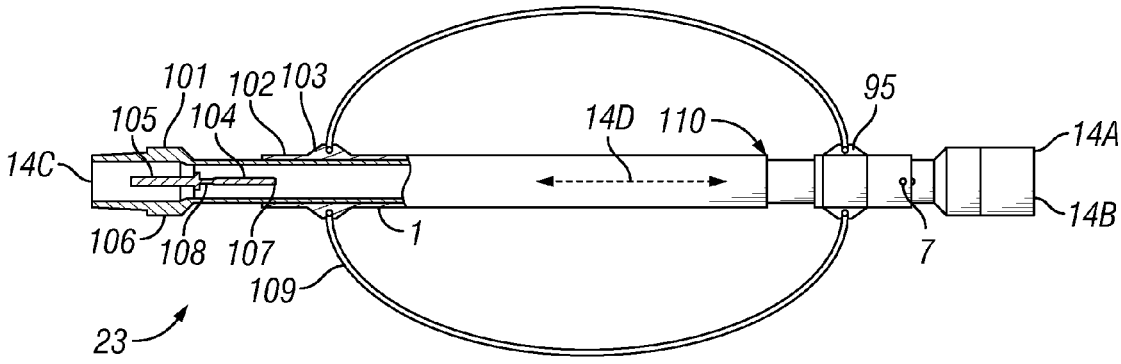
FIG. 2 shows one example caliper according to the invention.

On example of a caliper instrument is shown in side view in FIG. 2. The caliper instrument 23 may be formed on a mandrel 14A made of steel, or non-magnetic alloy such as monel, stainless steel or an alloy sold under the trademark INCONEL, which is a registered trademark of Huntington Alloys Corporation, Huntington, W. Va. The mandrel 14A may include a central bore or passage 14D as does any other typical segment of pipe to be coupled within a drill string, and preferably has a threaded connection 14B, 14C at each longitudinal end to enable connection of the mandrel 14A into the drill string (12 in FIG. 1) at a selected longitudinal position therein. The example drilling system in FIG. 1 shows the position of the caliper to be within the MWD/LWD instrument string but such location is not a limitation on the scope of the present invention; the caliper may be located at any convenient longitudinal position within the drill string 12. An inner sliding sleeve 102, also made from steel or other non-magnetic metal such as the example materials explained above is slidably mounted on the exterior of the mandrel 14A and allows the caliper instrument 23 to be moved along the wellbore in either direction as the drill string (12 in FIG. 1) is inserted into the wellbore or withdrawn therefrom, respectively. The inner sliding sleeve 102 also transmits movement of other components (explained below) of the caliper 23 to a position measurement sensor 105, e.g., a linear potentiometer or a linear variable differential transformer ("LVDT"), so that motion of the sliding sleeve 102 may be converted into a measurement corresponding to the wellbore diameter. The outer sliding sleeve 102 may be rotationally fixed as will be explained below by a cross-pin 107.

An outer sliding sleeve 103 is slidably mounted externally to inner sliding sleeve 102 and may be mounted thereon to enable relative rotation between the inner sleeve 102 and the outer sleeve 103. The outer sliding sleeve 103 may be coupled to one end of one or more bowsprings 109 of types well known in the art and formed, for example, from spring steel, copper-beryllium alloy or similar resilient material. The inner sliding sleeve 103, being rotatably mounted on the inner sliding sleeve 102 enables the bowspring(s) 109 to rotate relative to the mandrel 14A to prevent torque-induced damage while transmitting longitudinal motion of the end(s) of the bowspring(s) 109 to the inner sliding sleeve 102. As the bowspring(s) 109 is compressed laterally, the bowspring 109 will extend in length. Such extension causes corresponding longitudinal movement of the outer sliding sleeve 103, which is transmitted to cause corresponding longitudinal motion along the mandrel 14A of the inner sliding sleeve 102. The other longitudinal end of the bowspring 109 may be coupled to the mandrel 14A in a longitudinally fixed position, such as by a longitudinally fixed, rotatably mounted end sleeve 95. The end sleeve 95 preferably includes provision to enable it to rotate with respect to the mandrel 14A, just as does the outer sliding sleeve 103, but unlike the outer sliding sleeve remains longitudinally fixed with respect to the mandrel 14A. Thus, the bowspring(s) 109 are longitudinally fixed at one end, are free to move longitudinally at the other end. The bowspring(s) are also free to rotate about the mandrel 14A.

The mandrel 14A may include a slot 104 or similar opening therein to enable the aforementioned cross-pin 107 or the like to couple longitudinal motion of the inner sliding sleeve 102 to a push rod 108. The cross-pin 107 will fix the rotational position of the inner sliding sleeve 102 with respect to the mandrel 14A, but enables free longitudinal movement of the inner sliding sleeve 102 with respect to the mandrel 14A. The push rod 108 can be coupled to the sensor (e.g., the potentiometer or LVDT) 105 so that motion thereof is transformed into a signal corresponding to the longitudinal position of the inner sliding sleeve 102. Such position will be related to the lateral extension of the bowspring(s) 109. The sensor 105 may be disposed in a suitable, pressure sealed chamber (not shown separately) within a selected part of the mandrel 14A. A seal 106 can engage the outer surface of the push rod 108 and thereby exclude fluid from the wellbore from entering the chamber (not shown) where the sensor 105 is disposed.

The example shown in FIG. 2 may include two, circumferentially opposed bowsprings 109 each coupled to the outer sliding sleeve 103 as shown. A shoulder 110 limits axial motion of the inner sliding sleeve 102 when the mandrel 14A changes direction of motion within the wellbore. In other examples, linear motion of the inner sliding sleeve 102 may be coupled to the sensor 105 using a magnetic motion coupling rather than a pushrod. See, for example U.S. Pat. No. 5,917,774 issued to Walkow et al. Using a magnetic motion coupling would eliminate the need to provide any openings in the chamber (not shown) through which movable objects must pass, so that pressure seal could be more easily maintained. Use of a magnetic motion coupling will depend on the configuration of the LWD/MWD instruments, specifically, whether and where any magnetic directional sensing devices may be disposed within such instrument string, and how well the magnetic motion coupling can be configured to provide a closed magnetic flux loop.

Figure 3A:
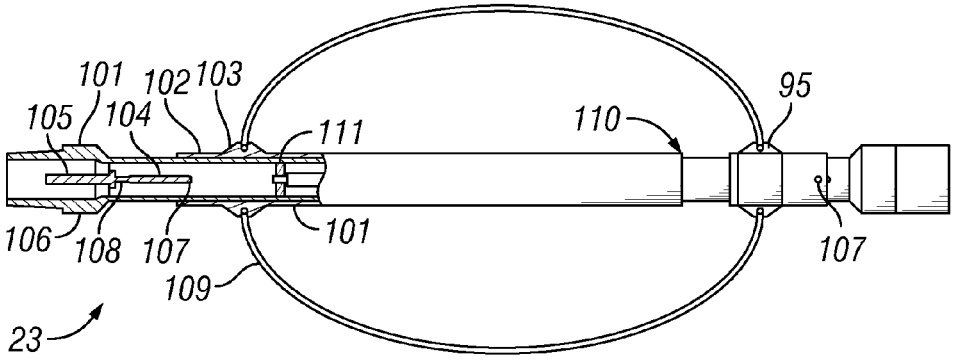
FIG. 3A shows another example caliper.
Figure 3B:
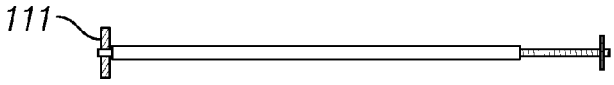
FIGS. 3B and 3C show an example "powered" caliper in open (3B) and closed (3C) positions.
Figure 3C:
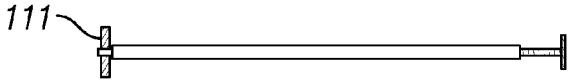

The example shown in FIG. 2 may be referred to as a "passive" caliper, in that the bowsprings 109 may remain in constant contact with the wellbore wall. In some instances it may be desirable to operate the caliper so that the bowsprings 109 only contact the wellbore wall when measurements are needed, and more specifically, may be retracted from the wellbore wall during certain drilling operations to reduce possible interference with drilling operations and possible damage to the caliper. Referring to FIGS. 3A-3C, one example of such retractable caliper will be explained. The measurement components of the caliper shown in FIG. 3A-3C may be similar to those shown in FIG. 2 (e.g., bowspring(s), sliding sleeve, cross-pin, pushrod, sensor, etc.). In the examples of FIG. 3A-3C, however, an actuator 111 may be included. The actuator 111 may be, for example, a piston and an hydraulic cylinder combination, a screw and threaded sleeve combination or any other device that can be selectively operated to extend and retract in overall length. FIG. 3A shows the actuator 111 in its extended position, such that the inner sliding sleeve 102 is urged longitudinally away from the longitudinally fixed end (at sleeve 95) of the bowsprings 109. Such urging causes the bowsprings 109 to extend longitudinally and therefore to contract laterally. When so laterally contracted, the bowsprings 109 may be withdrawn from contact with the wellbore wall to enable drilling operations to take place. FIG. 3B shows the actuator in its retracted position, such that the bowsprings 109 are not longitudinally extended by the actuator 111 and thus may operate substantially as explained with reference to FIG. 2.

In some examples, using bowsprings as the caliper wall contacting elements may be considered unsuitable for expected wellbore and/or drilling conditions. It may be desirable, therefore, to supplement the structural integrity of the caliper by using external arms or similar devices made from relatively thick (and thus strong), substantially rigid metal components. Such arm structures may be the devices placed in contact with the wellbore wall (by lateral biasing or urging) during operation, rather than the bowsprings as in the previous examples. When using such contact arms, the stresses encountered during certain wellbore operations are not transmitted directly to the springs or other biasing devices, however changes in wellbore diameter may be freely transmitted to the corresponding components that measure position in relation to the lateral extension of the springs (e.g., the sensor 105 in FIG. 2).

Figure 4:
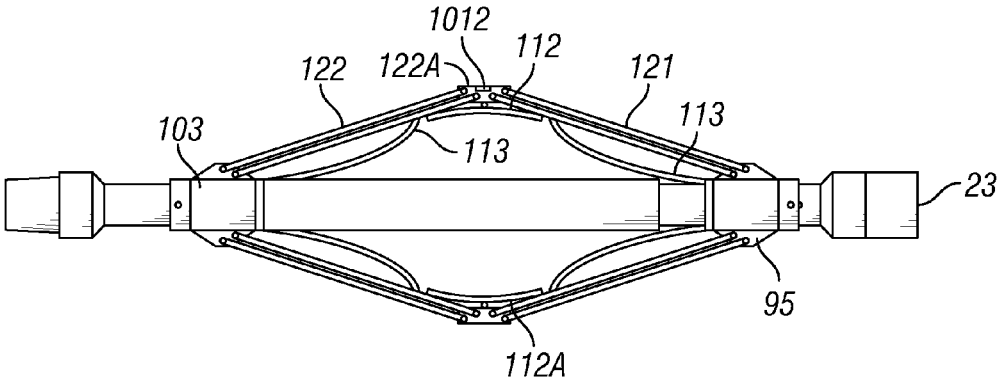
FIGS. 4 and 5 show other examples of a caliper.

One example of a caliper device using rigid arms is shown in FIG. 4. Instead of having a bowspring extend between the outer sliding sleeve 103 and the fixed end sleeve 95, a linkage system may be provided including a first link 121, a second link 122 and a link coupling 122A may be coupled between the fixed end sleeve 95 and the outer sliding sleeve 103. The links may be coupled at the fixed end directly to the mandrel 14A or may be coupled thereto using a sliding sleeve 95 as shown in FIG. 4 to enable relative rotation, as in the previous examples of FIGS. 2 and 3. The links 121, 122 may be pivotally coupled to the respective ends 103, 107 and to the link coupling 122A. The links 121, 122 may be formed for example as substantially U-shaped channels from plate steel (or stainless steel, monel or the INCONEL alloy as other examples) to obtain substantial strength and bending resistance. The links 121, 122 may be urged outward laterally by suitably placed leaf springs 113, 112 or the like. Alternatively, the longitudinal ends 103, 95 may be urged together by a coil spring (not shown) to cause corresponding outward urging of the linkage components. As in the bowspring examples explained above, lateral compression of the links by changes in wellbore diameter will result in corresponding longitudinal movement of the free end thereof through the outer sliding sleeve 103. Translation of movement of the out sliding sleeve 103 may be communicated to a sensor (105 in FIG. 2) substantially as explained above with reference to FIG. 2. If selective engagement of the links with the wellbore wall is desired, the example shown in FIG. 4 may also include an actuator substantially as explained with reference to FIGS. 3A and 3B.

Figure 5:
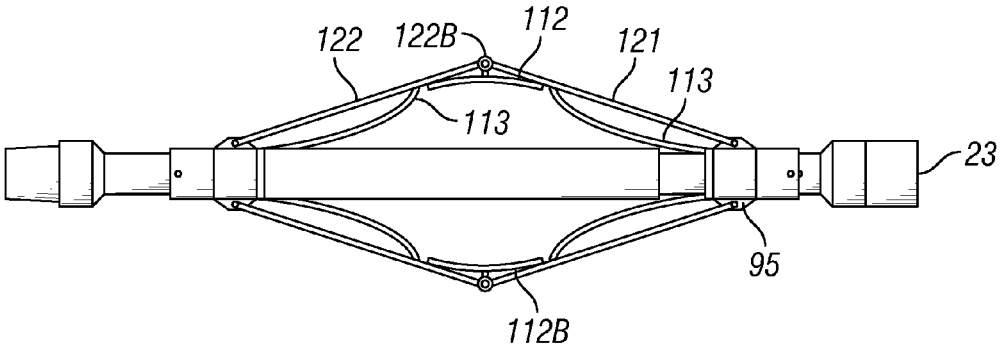

An alternative to the arrangement shown in FIG. 4 is shown in FIG. 5. The only substantive difference between the examples of FIGS. 4 and 5 is the use of a pivot 122B to couple the outer ends of the links 121, 122 in the example of FIG. 5, rather than the link coupling shown in FIG. 4. The examples shown in FIGS. 4 and 5 include pivotal coupling of the links at each longitudinal end to a component of the mandrel 14A. In other examples, the links may be coupled at only one end and extend laterally outwardly so that the free end is what is placed in contact with the wall of the wellbore. Such caliper arm configurations are well known for use with "wireline" conveyed well logging instruments.

One or more of the links 121, 122, bowsprings 109, link couplings 112A, 122A, pivot 122B may be instrumented with a sensor or sensing device to measure a property of the formation, a property of the formation fluid, a property of the drilling fluid, and/or a relative position of the respective component. For example, the link coupling 122A in FIG. 4, illustrates a sensor 1012 capable of measuring a property of the formation in which it may contact when extended. It should also be understood that the sensor 1012 may measure a property of the formation or formation fluid from a retracted position, and, as a result, the sensor 1012 may be capable of obtaining measurements while drilling. The sensor may be configured to measure any specific formation property such as resistivity, velocity, indentation resistance, and other parameters of interest that will be appreciated by a person having ordinary skill in the art. As an example, the sensor may be capable of measuring contact force with the formation. Measurements and other data from the sensor 1012 may be transmitted to an electronics package within the drill collar (not shown separately) for further processing and preparation for transmission uphole. Based on the measurement, the caliper may be activated, such as by extending the bowsprings 109 and/or link couplings 112A, 122A and/or by activating the actuator 111. Specifically, based on the measurement, a command signal may be transmitted to one of these components to extend or retract the caliper.

A plurality of the sensors 1012 may be positioned on the links 121, 122, bowsprings 109, link couplings 112A, 122A, pivot 122B. One of the sensors 1012 may measure a formation property, and another one of the sensors 1012 may measure a position of the one or more of the links 121, 122, bowsprings 109, link couplings 112A, 122A, pivot 122B. For example, the sensor 1012 may measure a contact force of the bowsprings 109 and/or a distance in which the bowsprings 109 have extended and/or retracted. The sensor 1012 may measure a position of the actuator 111, link couplings 112A, 122A, and/or pivot 122B. In an embodiment the sensor 1012 may measure a property of the formation and/or wellbore and a position and/or contact force of the bowsprings 109, actuator 111, link couplings 112A, 122A, and/or pivot 122B.

Figure 6:
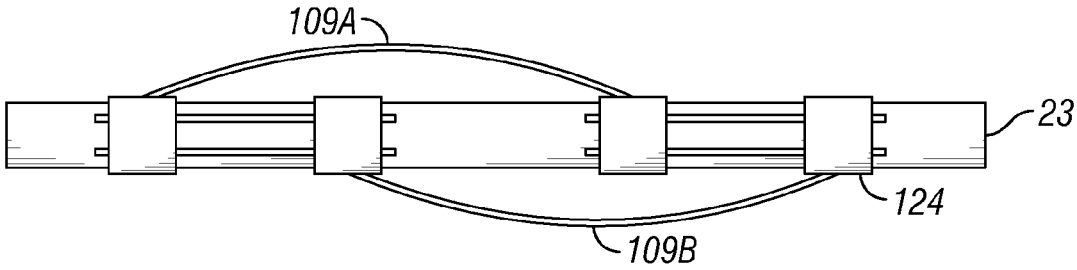
FIGS. 6 and 7 show other examples of a caliper.

In all the foregoing examples, the bowsprings or links are coupled to the same longitudinal end components (e.g., the sleeves). A result of such configuration is that the longitudinal position of the outer and/or inner sliding sleeves (and thus the sensor) is related to an average lateral extension of the bowsprings or linkages. Such arrangement may be unsuitable if it is anticipated that the wellbore will be non-circularly shaped and knowledge of such shape is desirable. Examples shown in FIGS. 6 and 7 may have longitudinally offset bowsprings (or may instead use longitudinally offset linkage arrangements such as shown in FIGS. 4 and 5). In FIG. 6, a first bowspring 109A may be longitudinally offset from a second bowspring 109B. Unlike the example explained with reference to FIG. 2, the example in FIG. 6 may include sleeves 124 arranged to enable longitudinal motion of the ends of the bowsprings 109A, 109B, but to keep them in rotationally fixed orientation. A corresponding example shown in FIG. 7 includes bowsprings 109A, 109B, 109C arranged so that one of the bowsprings 109C is kept in contact with the wellbore wall at 90 degrees rotational offset from the other two bowsprings 109A, 109B, thus enabling measurement of a major and minor diameter of the wellbore wall when the wellbore is not circularly shaped. It should be noted that the sensor 1012 may also be incorporated to the bowsprings embodiments shown in FIGS. 6 and 7.

Figure 7:
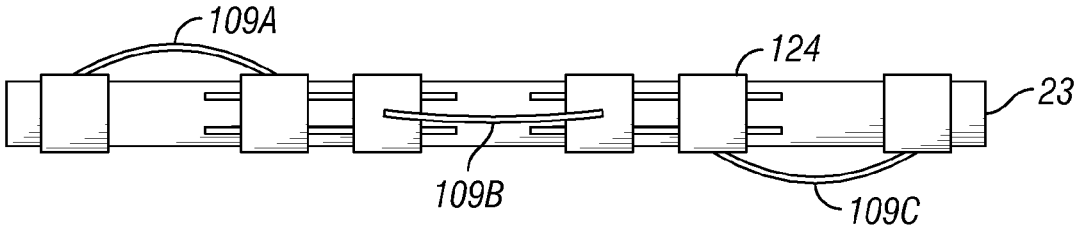
Figure 8:
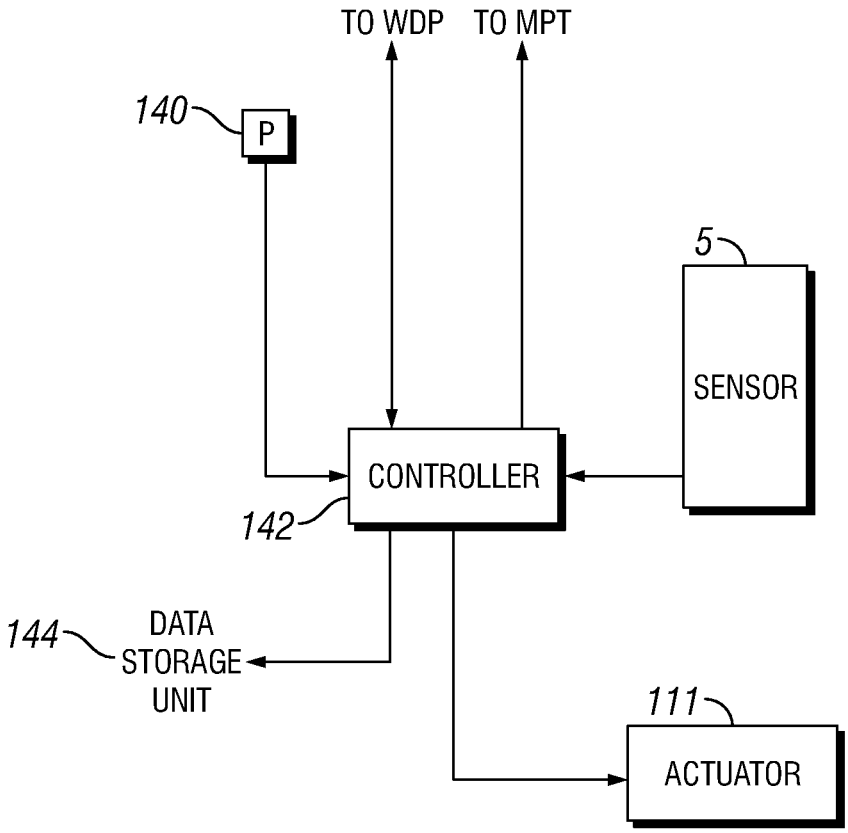
FIG. 8 shows an example control system for a caliper.

As explained above, in some examples it may be desirable to cause the arms or springs of the caliper to contact the wellbore wall only at certain times or under certain conditions. One example includes having the actuator (see FIGS. 3A and 3B) be operable by command from the surface to open or close upon detection of such command. An example control system that may be used to operate the caliper according to different drill string configurations and drilling conditions is shown schematically in FIG. 8. The sensor 5 (or, if a configuration such as shown in FIG. 7 is used a plurality of such sensors) may be in signal communication with a controller 142, such as a programmable general purpose microprocessor or an application specific integrated circuit. The controller 142 may communicate signals from the sensor 5 to a data storage device, such as a hard drive or solid state memory 144 disposed in the instrument string (e.g., in 22 in FIG. 1). The controller 142 may be in signal communication with the telemetry communication channel of wired drill pipe, if such is used as the pipe string (12 in FIG. 1) or the mud flow modulator (as explained with reference to FIG. 1) for communication of selected signals to the recording unit (38 in FIG. 1).

In some examples, the controller 142 may be configured to respond to certain command signals transmitted from the surface (e.g., the recording system 38 in FIG. 1). In response to such commands, the controller 142 may operate the actuator 111 to open the caliper as explained above. Caliper measurements may be made, and for example, recorded in the data mass storage unit 144 while the pipe string is withdrawn from the wellbore. In this way, the caliper will not interfere with drilling operations, but will make measurements during non-operating times. In such examples, the caliper may be closed with the caliper is fully withdrawn to the surface, or may, upon receipt of a suitable command signal from the recording unit, may operate the actuator to close the caliper.

The foregoing examples have shown one, two and four caliper arms, typically circumferentially spaced evenly from each other when more than one caliper arm is used. It is to be clearly understood that the number of caliper arms is a matter of choice for the system designer and that any number of caliper arms structured as claimed below is within the scope of the present invention. The caliper has also been described as being arranged to place the arm(s) in contact with a wall of the wellbore. As will be readily appreciated by those skilled in the art, the wall of the wellbore in certain portions thereof may include a pipe of casing disposed therein. The present invention is equally well suited to measure the internal diameter of cased portions of the wellbore wall as it is in those portions not having casing therein ("open hole").

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A system for use in a wellbore comprising
- a drill string comprising a plurality of pipe joints;
- a laterally extendible arm coupled to the drill string and extendable to a wall of the wellbore;
- a biasing device configured to urge the laterally extendible arm toward the wall of the wellbore; and
- a first sensor connected to the biasing device or the laterally extendible arm to measure a property of a formation about the wellbore, wherein the biasing device is positioned at least two pipe joints from a bottom hole assembly of the drill string.

2. The system of claim 1 further comprising a second sensor configured to measure a position of the biasing device or the laterally extendible arm.

3. The system of claim 1 further comprising a second sensor configured to measure a property of drilling fluid adjacent the drill string.

4. The system of claim 1 wherein the first sensor is configured to measure a resistivity of the formation about the wellbore.

5. The system of claim 1 wherein the first sensor is configured to measure a contact force of the biasing device or the laterally extendible arm and the formation about the wellbore.

6. The system of claim 1 wherein the first sensor is capable of measuring the property of the formation if the biasing device is in a retracted position or an extended position.

7. The system of claim 1 wherein the first sensor is capable of measuring the property of the formation if the laterally extendible arm is in a retracted position or an extended position.

8. The system of claim 1 wherein the first sensor is capable of measuring the property of the formation while the drill sting is moving through the wellbore.

9. The system of claim 1 wherein the first sensor is capable of measuring the property of the formation while drilling the wellbore.

10. A system for use in a wellbore comprising:
- a caliper positionable on a drill string comprising:
  - a laterally extending arm configured to contact a wall of the wellbore;
  - an actuator to control movement of the laterally extending arm between an extended position and a retracted position, the extended position being closer to the wall of the wellbore than the retracted position; and
  - a sensor connected to the actuator or the laterally extending arm to measure a property of a formation about the wellbore,
- wherein the caliper is positioned along the drill string at least two pipe joints of the drill string from a bottom hole assembly of the drill string.

11. The system of claim 10 wherein the caliper communicates with a surface device.

12. The system of claim 11 wherein the caliper is powered by the repeater.

13. The system of claim 10 wherein the drill string comprises wired drill pipe having a communication channel communicatively coupled at each pipe joint, and a repeater positioned between two pipe joints of the wired drill pipe.

14. A method comprising:
- positioning a caliper along a drill string at least two pipe joints of the drill string from a bottom hole assembly;
- deploying the caliper into a wellbore;
- actuating the caliper to extend a laterally extending arm to contact a wall of the wellbore; and
- communicating a position of the caliper or a property of a formation about the wellbore to the Earth's surface.

15. The method of claim 14 wherein the caliper is deployed via a drill string and further wherein at least a portion of the drill string is wired drill pipe.

16. The method of claim 15 further comprising positioning a repeater in the drill string and powering the caliper with the repeater.

17. The method of claim 14 wherein the step of communicating includes communicating the property of the formation about wellbore to the Earth's surface and further wherein a sensor positioned on the laterally extending arm provides the measurement of the formation.

18. The method of claim 14 further comprising transmitting a command to the caliper to retract the laterally extending arm.

* * * * *